US012390742B2

(12) United States Patent
Baumann et al.

(10) Patent No.: US 12,390,742 B2
(45) Date of Patent: Aug. 19, 2025

(54) CRUMPLE TOY

(71) Applicant: Krumples, LLC, Ferndale, WA (US)

(72) Inventors: Scott Baumann, Anacortes, WA (US); Edwin Cheong, Blaine, WA (US)

(73) Assignee: Krumples, LLC, Ferndale, WA (US)

( * ) Notice: Subject to any disclaimer, the term of this patent is extended or adjusted under 35 U.S.C. 154(b) by 0 days.

(21) Appl. No.: 18/749,940

(22) Filed: Jun. 21, 2024

(65) Prior Publication Data

US 2024/0424420 A1 Dec. 26, 2024

Related U.S. Application Data

(60) Provisional application No. 63/522,219, filed on Jun. 21, 2023.

(51) Int. Cl.
*A63H 33/00* (2006.01)

(52) U.S. Cl.
CPC ..... *A63H 33/00* (2013.01)

(58) Field of Classification Search
CPC ..... A63H 5/00; A63H 33/00; A63H 33/006
USPC ..... 446/176, 227
See application file for complete search history.

(56) References Cited

U.S. PATENT DOCUMENTS 2,224,456 A * 12/1940 Janas ..... A63H 9/00 446/318
2,817,187 A * 12/1957 Auzin ..... A63H 3/06 D11/158
3,032,921 A * 5/1962 Greene ..... A63H 3/48 446/190
D198,857 S * 8/1964 Rabin ..... D21/600
3,453,774 A * 7/1969 Gruber ..... A63H 33/00 446/353
3,691,675 A * 9/1972 Rodgers ..... A63H 13/16 446/188
4,034,499 A * 7/1977 Wild ..... A63H 5/00 446/215
4,114,501 A * 9/1978 Tanaka ..... G10K 5/00 446/193
D253,668 S * 12/1979 Takasaka ..... D21/585
4,271,744 A * 6/1981 Kulesza ..... A63H 5/00 84/476
5,162,012 A * 11/1992 Blandi ..... A63H 33/006 446/298
5,261,850 A * 11/1993 Barthold ..... A63H 3/06 446/180
5,310,380 A * 5/1994 Levy ..... A63H 3/36 446/370
6,422,912 B1 * 7/2002 Summers ..... A61L 9/12 446/73
7,642,438 B1 * 1/2010 Cohen ..... G10K 9/04 446/192

(Continued)

*Primary Examiner* — Kurt Fernstrom
(74) *Attorney, Agent, or Firm* — Kevin Keener; Keener and Associates P.C.

(57) ABSTRACT

A compressible and extendable toy is disclosed. The toy has a plurality of alternating ribs and folds. When the toy is in the compressed state the folds are folded into the toy. When the toy is in the extended state, the folds are extended into an unfolded position. The toy has a handle on a first end. The toy may have a handle on the second end. Alternatively, the toy has a suction cup on the second end. The internal cavity of the toy may be completely enclosed or have openings at the ends of the toy or apertures in the folds or ribs.

21 Claims, 12 Drawing Sheets

(56) References Cited

U.S. PATENT DOCUMENTS

| | | | | |
|---|---|---|---|---|
| 10,602,719 | B2 * | 3/2020 | Cao | A01K 15/026 |
| 11,738,280 | B2 * | 8/2023 | Clark | A63H 3/44<br>446/374 |
| 2008/0182479 | A1 * | 7/2008 | Elliott | A63H 33/26<br>446/73 |
| 2014/0199912 | A1 * | 7/2014 | Fish | A63H 3/04<br>446/383 |
| 2020/0245591 | A1 * | 8/2020 | Bentz | A63H 3/31 |
| 2022/0401846 | A1 * | 12/2022 | Tortorici | A63H 3/02 |
| 2023/0159222 | A1 | 5/2023 | Tsui | |
| 2024/0058718 | A1 * | 2/2024 | Vandoren | A63H 33/042 |

* cited by examiner

CRUMPLE TOY

CROSS-REFERENCE TO RELATED APPLICATION

This application claims priority from U.S. Provisional Patent Application 63/522,219, filed on Jun. 21, 2023, the disclosure of which is included herein in its entirety.

FIELD OF THE INVENTION

This invention pertains to a fidget toy and more specifically to a crumple toy that expands and contracts having one or more ribs and folds.

BACKGROUND OF INVENTION

Fidget toys offer several key benefits, especially for children and individuals, regardless of age, who may benefit from sensory stimulation or have trouble focusing caused by anxiety or stress, attention-deficit hyperactivity disorder (ADHD), attention-deficit disorder (ADD), autism spectrum disorder (ASD), obsessive-compulsive disorder (OCD), or simply a general lack of focus. Other factors such as nervousness or tension can also make it difficult for individuals to concentrate free from distraction. Fidget toys can reduce stress and anxiety, enhance dexterity, while improving attitude and coordination. They can also have a calming effect and are a great way to channel excess energy, which can help improve focus and subsequently increase attention span.

By providing auditory, visual, or tactile input, fidget toys can help individuals improve their concentration and regulate their emotions. Fidgeting with the hands can help increase dopamine and norepinephrine levels in the brain boosting attention and sharpening focus. Engaging with a fidget toy can also trigger the release of endorphins, the body's natural mood enhancers, which can assist in improving mood and overall well-being. Fidget toys have the potential to benefit a diverse range of individuals with or without cognitive deficiencies, processing disorders, or deficits in attention by providing a means to manage stress, improve focus, regulate sensory input, and promote relaxation.

While fidget toys can be highly beneficial for many users, there is a wide variety in the marketplace and varying toys offer different potential benefits. While unique individuals require unique needs, it has been shown that tactile, visual, and auditory inputs are most often recommended allowing the user some level of activity while still affording focus and attention. Simply giving the hands something to do has overall proven increasingly effective.

Some fidget toys may be manufactured poorly or designed with low-quality materials, leading to issues such as breakage or malfunctioning parts. Certain fidgets may also have small parts or components that pose a choking hazard for young children or individuals prone to placing objects in their mouths. In addition, some fidgets may contain materials that are harmful if ingested. Certain fidget toys with an overly eccentric auditory experience may pose a distraction in environments where quiet concentration is necessary and cause disruption. Other fidgets may be designed to overstimulate a user visually, but might have the opposite effect of interfering with their ability to concentrate, relax, or pay attention.

What is needed is a fidget toy that focuses on and carefully stimulates the recommended inputs and is most functional and experienced in the hands of the user giving them the ability to extend and contract a toy in any number of unique forms.

Additionally, toys that are tactile are extremely fun and engaging for individuals and children. Tactile toys can be utilized by individuals with obsessive-compulsive disorder (OCD) to channel energies into a positive channel. Larger tactile toys can also be utilized by children with special needs. Lastly, large tactile toys are fun for all types of individuals. What is needed is a tactile toy that can be utilized for general fun and for children with OCD and/or special needs.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

In accordance with the present invention, there is provided one embodiment, a crumple toy made of a tactile material that has the ability to extend and contract allowing the user to fidget and manage stress, improve focus, regulate sensory input, and promote relaxation. The crumple toy is generally cylindrical and comprised of any number of ribs and folds that may be pulled open or closed with handles or suction cups or a combination of both. The crumple toy allows a user to fidget by means of extending and contracting the body of the toy into a contracted body or extended body configuration, as the extended body may be any length greater than the contracted body.

The crumple toy comprises a body of any shape having ribs that may be orientated in a contracted body or extended body position. The crumple toy further comprises a body having one or more alternating ribs and folds that when the contracted body is pulled outward the ribs separate and the folds become visible in the extended body position. Having a contracted body, the folds of the crumple toy are positioned internally of the body and the ribs are disposed adjacent of each other. Having an extended body, the ribs are extended longitudinally along the body of the crumple toy as such the ribs are no longer adjacent to each other and the folds move radially outward from the body of the toy and become visible.

The invention is directed toward a toy comprising a longitudinal body having a first end and a second end opposite said first end; said longitudinal body comprising a plurality of ribs and a plurality of folds, wherein at least one of said plurality of ribs is disposed between two of said plurality of folds; wherein at least one of said plurality of folds is disposed between two of said plurality of ribs; wherein said longitudinal body is configured to be adjusted between a first configuration and a second configuration; wherein when said longitudinal body is in said first configuration two adjacent ribs are in a distal position relative to each other with an intervening fold in an unfolded position; wherein when said longitudinal body is in said second configuration two adjacent ribs are disposed proximal relative to each other with an intervening fold in a folded position; and a first handle disposed at said first end.

The toy may further comprise a second handle disposed at said second end. The toy may further comprise a suction cup disposed at said second end. The toy may further comprise one or more apertures disposed in at least one of said plurality of folds. The first end may further comprise a first end opening. In some embodiments the second end further comprises a second end opening.

In another embodiment the first end further comprises a closed first end and said second end further comprises a closed second end, such that said closed first end, said closed second end, and said longitudinal body define an internal cavity having no interaction with space outside of said longitudinal body. In some embodiments, when said longitudinal body is in said first configuration said internal cavity creates a vacuum relative to space outside of said longitudinal body. The vacuum causes said longitudinal body to compress into said second configuration. In other embodiments when said longitudinal body is in said second configuration said internal cavity creates positive air pressure relative to space outside of said longitudinal body. The positive air pressure causes said longitudinal body to extend to said first configuration.

In other embodiments the toy may further comprise one or more compressible dimples disposed in at least one of said plurality of ribs. In other embodiments the toy may further comprise a plurality of lateral protrusions extending substantially perpendicular to said longitudinal axis.

The invention is also directed toward a toy comprising a longitudinal body having a first end and a second end opposite said first end; said longitudinal body comprising a plurality of ribs and a plurality of folds, wherein at least one of said plurality of ribs is disposed between two of said plurality of folds; wherein at least one of said plurality of folds is disposed between two of said plurality of ribs; wherein said longitudinal body is configured to be adjusted between a first configuration and a second configuration; wherein when said longitudinal body is in said first configuration said longitudinal body is fully extended along a longitudinal axis such that said first end is disposed at a maximum distance from said second end; wherein when said longitudinal body is in said second configuration said longitudinal body is compressed along a longitudinal axis such that said first end is disposed at less than said maximum distance from said second end; and a first handle disposed at said first end The primary object of the invention is to provide an easy and accessible way to help a user self-regulate or concentrate by providing tactile, visual, and/or auditory input through the use of a crumple toy that diverts excessive energy and improves focus.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

Figure 1:
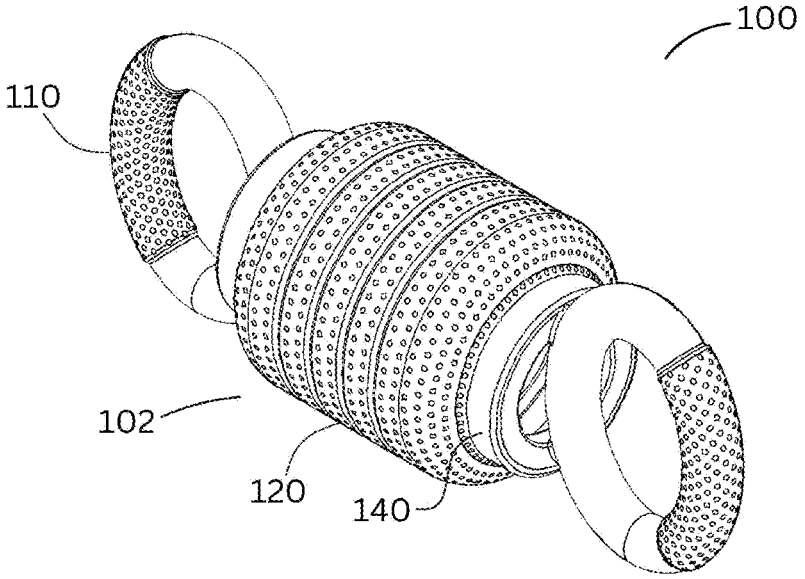
FIG. 1 is a horizontal perspective view of the crumple toy in a contracted configuration in accordance with an embodiment of the present invention.
Figure 2:
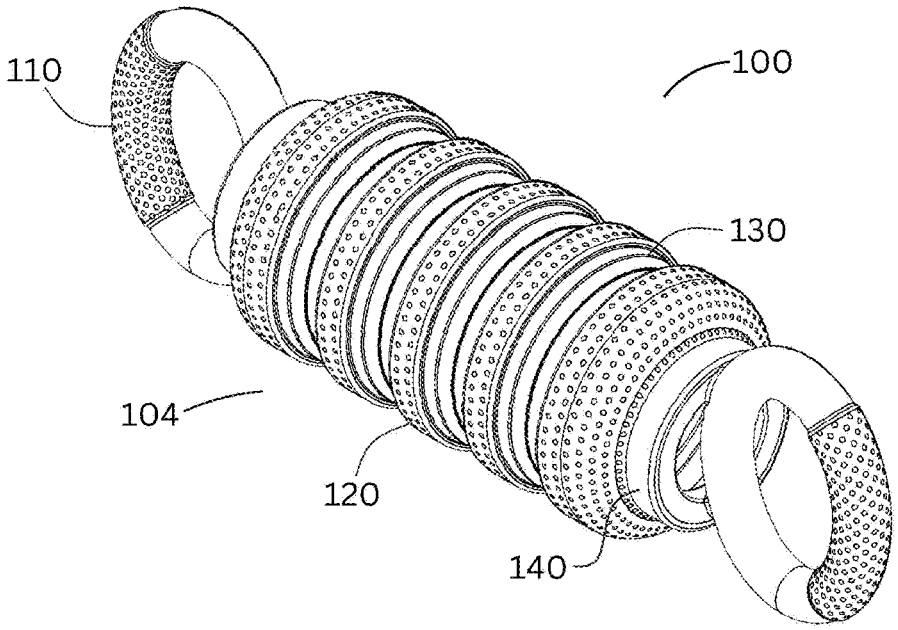
FIG. 2 is a horizontal perspective view of the crumple toy in an extended configuration in accordance with an embodiment of the present invention.
Figure 3:
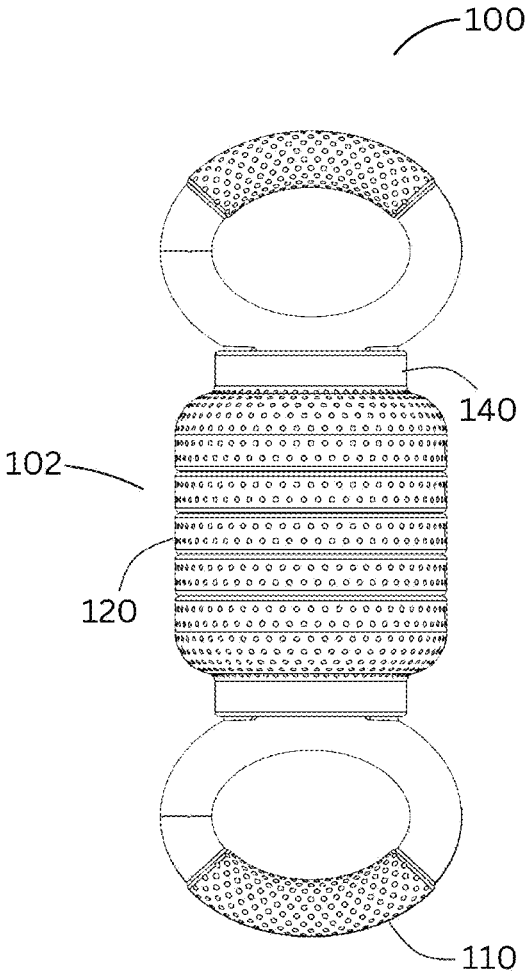
FIG. 3 is a front view of the crumple toy in a contracted configuration.
Figure 4:
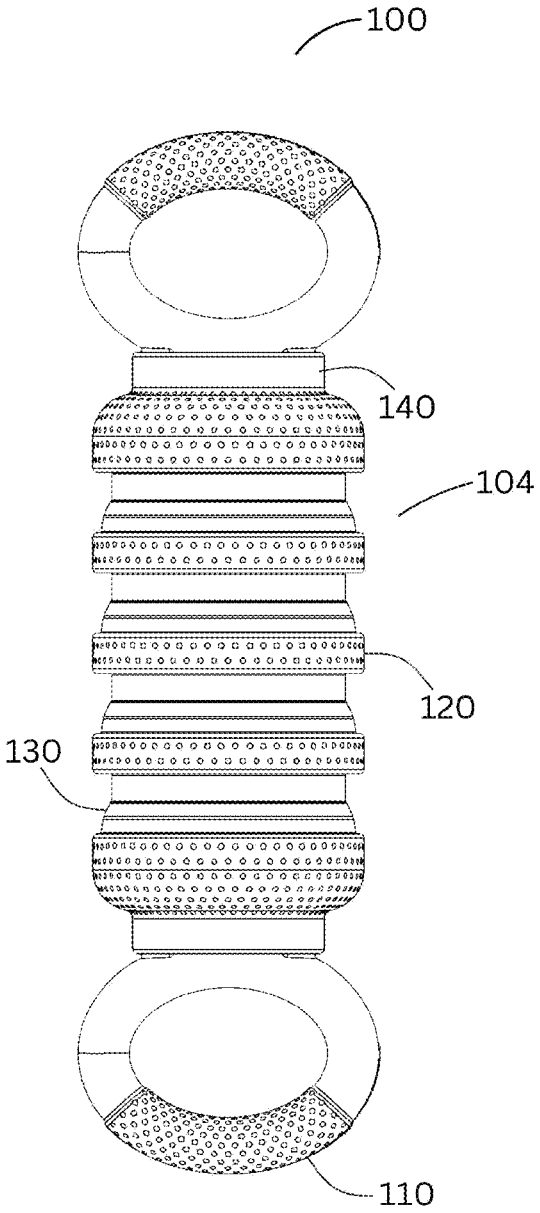
FIG. 4 is a front view of the crumple toy in an extended configuration.
Figure 5:
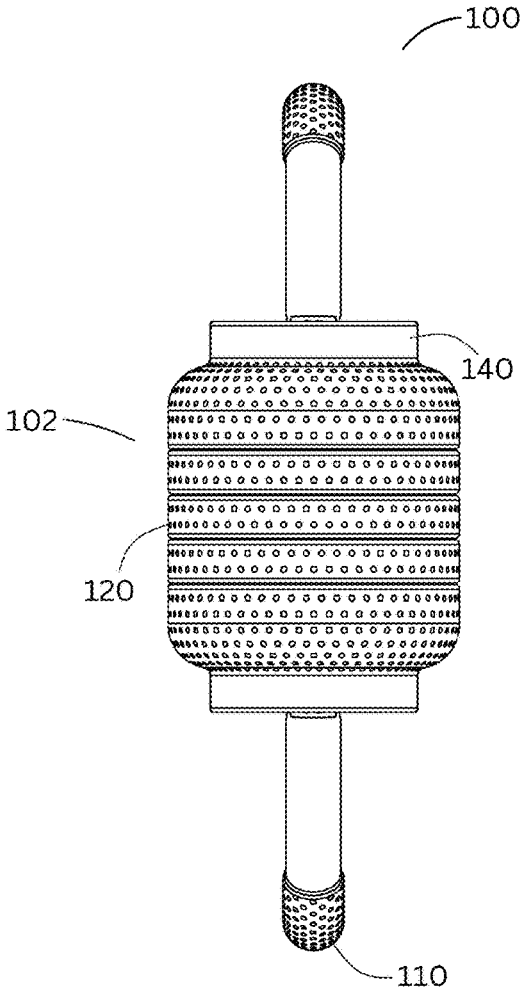
FIG. 5 is a right side view of the crumple toy in a contracted configuration.
Figure 6:
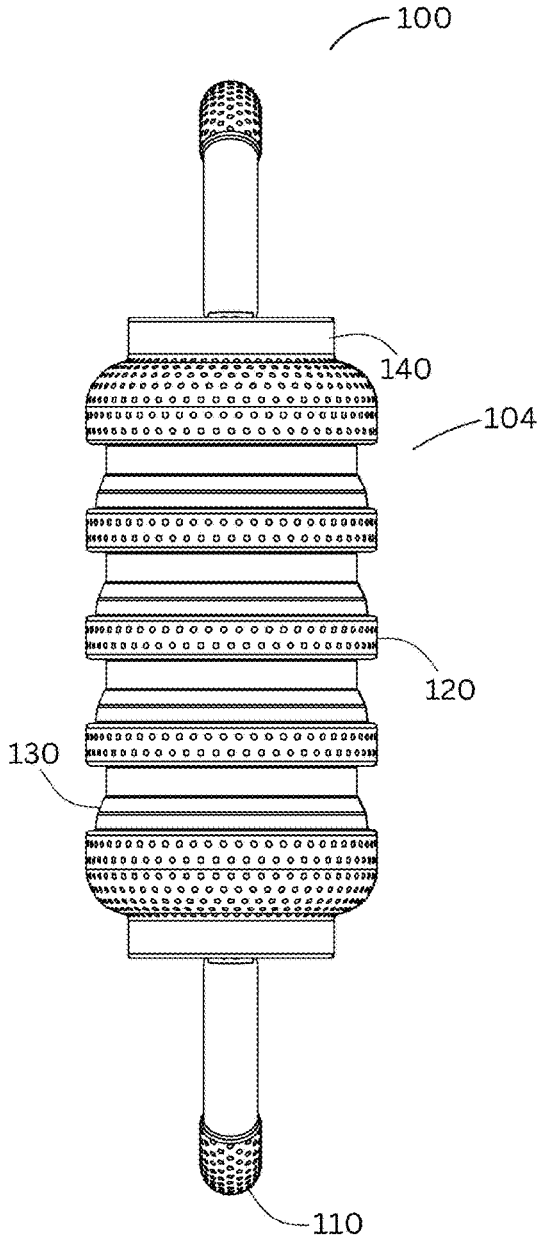
FIG. 6 is a right side view of the crumple toy in an extended configuration.

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Referring to FIGS. 1-6 is a crumple toy 100 designed as a toy allowing a user to fidget by means of extending and contracting the body of the toy into a contracted body 102 or extended body 104 configuration, as the extended body 104 may be any length greater than the contracted body 102. The crumple toy 100 comprises a body of any shape having ribs 120 that may be orientated in a contracted body 102 or extended body 104 position. In the preferred embodiment the crumple toy 100 comprises a body having one or more alternating ribs 120 and folds 130 that when the contracted body 102 is pulled outward the ribs 120 separate and the folds 130 become visible in the extended body 104 position. Having a contracted body 102, the folds 130 of the crumple toy 100 are positioned internally of the body and the ribs 120 are disposed adjacent of each other. Having an extended body 104, the ribs 120 are extended longitudinally along the body of the crumple toy 100 as such the ribs 120 are no longer adjacent to each other and the folds 130 move radially outward from the body of the toy and become visible.

In some embodiments the folds 130 are resilient and configured to return to an original position after being deformed. In this embodiment the folds 130 may be in a folded state naturally so that the crumple toy 100 starts in a contracted body 102 position. A user can pull the crumple toy 100 into an extended body 104 position. When the user releases the crumple toy 100, the resilient folds 130 pulls the crumple toy 100 back into the contracted body 102 position. Alternatively, the folds 130 may be in an unfolded stated naturally so that the crumple toy 100 starts in an extended body 104 position. A user can compress the crumple toy 100 into a contracted body 102 position. When the user releases the crumple toy 100, the resilient folds 130 push the crumple toy 100 back into an extended body 104 position.

In the preferred embodiment, each rib 120 is a concentric ring extending around the entire perimeter of the crumple toy 100 and each fold 130 is a concentric ring extending around the entire perimeter of the crumple toy 100. In other embodiments the ribs 120 may extend partially around the perimeter of the crumple toy 100 and the remaining perimeter may be folds 130 that extend and create the body of the toy and the folds 130 may extend partially around the perimeter of the crumple toy 100 and the remaining perimeter may be ribs 120 that extend and create the body of the toy.

In the preferred embodiment each rib 120 contains an internal rigid member to maintain a predetermined shape of the rib 120. The internal rigid member may be any shape or size and made from any material and may form a core within the rib 120 and may extend the entire circumference of the rib 120 or extend smaller segments. The ribs 120 and folds 130 may be malleable and manipulated by a user in a variety of chosen configurations. In other embodiments each rib 120 may be removably secured by any method or design to an adjacent rib 120 when in a contracted body 102 configuration. The ribs 120 may be any shape or configuration on the crumple toy 100 and may or not be perpendicular to the longitudinal axis of the body. The ribs 120 may be releasably coupled by suction when adjacent to one another in a contracted body 102 position.

There may be one or more than one collars 140 and may share an abutting edge with the proximal and distal ribs 120 and may be permanently joined or releasably coupled to either or both of the proximal and distal ribs 120. The handles 110 may be permanently joined or releasably coupled to the collars 140. The collars 140 and the handles 110 may be permanently joined or releasably coupled to the proximal and distal ribs 120. In the preferred embodiment the collars 140 are permanently joined to the proximal and distal ribs 120 and the handles 110. In other embodiments there are no collars 140. The handles 110 may be any size or shape and may have one or more than one handles 110 on the ends of the crumple toy 100. The handle 110 may be on either or both ends of the crumple toy 100. The handles 110 may be toroidal, spherical, circular, or any geometric or non-geometric shape. The handles 110 may be shaped as an animal, head, figurine, hand, or any other object or shape. In some embodiments, the crumple toy 100 has no handles.

The handle 110 may be an open handle with an aperture in the middle. In other embodiments the handle 110 may have a compressible silicone dimple. In this embodiment the dimple is a extended on one side of the handle 110 but can be pressed into the handle 110 so that the dimple extends into or toward the other side of the handle 110.

The crumple toy 100 may be made of rubber, neoprene, silicone rubber, thermoplastic elastomer, ethylene propylene diene monomer (EPDM), latex, silicone elastomer, or any other polymer or synthetic material that has pliable characteristics sufficient for successful operation of the crumple toy 100. In the preferred embodiment the crumple toy 100 is composed of silicone. The surface of the crumple toy 100 may be soft, smooth, rough, dimpled, hard, squishy, ridged, bumpy, pliable, furry, or any combination, or may have any additional surface textures or combinations of textures. There may be any portions of the surface of the crumple toy 100 that may have any texture on any area of the toy. The surface of the crumple toy 100 may be smooth and have ink printing on the surface of the crumple toy 100. Designs and colors may be applied to the surface of the crumple toy 100 in any manner.

In an alternative embodiment the ribs 120 of the crumple toy 100 may have a plurality of soft silicone bristles, or lateral protrusions, extending perpendicularly or in any direction from its outer surface. The soft silicone bristles may extend from the surface of the crumple toy 100 in any direction and at any angle from the surface of the crumple toy 100. There may be one or more than one soft silicone bristles and may extend from one or more than one of any of the ribs 120 of the crumple toy 100. In the contracted body 102 position the body of the crumple toy 100 is covered in soft silicone bristles that may engage a user with tactile stimulation.

In still another embodiment the ribs 120 of the crumple toy 100 may have a plurality of popping buttons, or dimples, on any or all of the ribs 120. A user may depress any of the buttons and position them in an inverted state. When depressed, the dimples are pressed into the body of the crumple toy 100. In some embodiments, when the crumple toy 100 is in an extended body 104 position with dimples depressed, the act of moving the crumple toy into a contracted body 102 position forces the dimples to return to the original protruding state. Alternatively, when any number of the dimples are in a depressed state and the crumple toy 100 is in a contracted body 102 position the toy may be pulled in an extended body 104 position and the dimples may return to the original protruding state. The dimples may make a popping sound when a user inverts or reverts the dimples.

The crumple toy 100 may be opaque, transparent, translucent, or may allow any or no amount of light to pass through. There may be one or any number of LED lights located in the inner cavity 106, on the external surface, or embedded in any number of ribs 120 and/or folds 130 of the crumple toy 100. There may be one or more switches on the toy utilized to activate the LED lights to turn on or off when the toy is in a specific configuration, as when specific ribs 120 are connected together in a contracted body 102 position or disconnected in an extended body 104 position. The switch may simply be a standard on and off toggle switch.

The crumple toy 100 may be any size or shape and have any cross-sectional profile. The ribs 120 and folds 130 may be any size or shape. In the preferred embodiment the body of the crumple toy is cylindrical with a circular cross-sectional profile. In other embodiments the crumple toy may be square or rectangular with a square or rectangular cross-section, triangular or pyramid shaped with a triangular cross-section, oval shaped with an oval cross section, spherical shaped with a circular cross-section, or any geometric shape or non-geometric shape with any shaped cross-section. The ribs 120 and folds 130 may be the same size or different sizes. The ribs 120 may be all the same size or may be of different sizes along the body of the toy. The folds 130 may be all the same size or may be of different sizes along the body of the toy. The ribs 120 and folds 130 may change size or shape as the toy is altered from the contracted body 102 position to the extended body 104 position or from the extended body 104 position to the contracted body 102 position. The crumple toy 100 may be any size and small enough to fit in the hand of the user or connect two fingers of said hand to the handles 110. In other embodiments the crumple toy 100 is extended and contracted using two hands in an accordion style action and in extra-large embodiments the crumple toy may be used as a seat for the user to engage their entire body on the toy.

Figure 7:
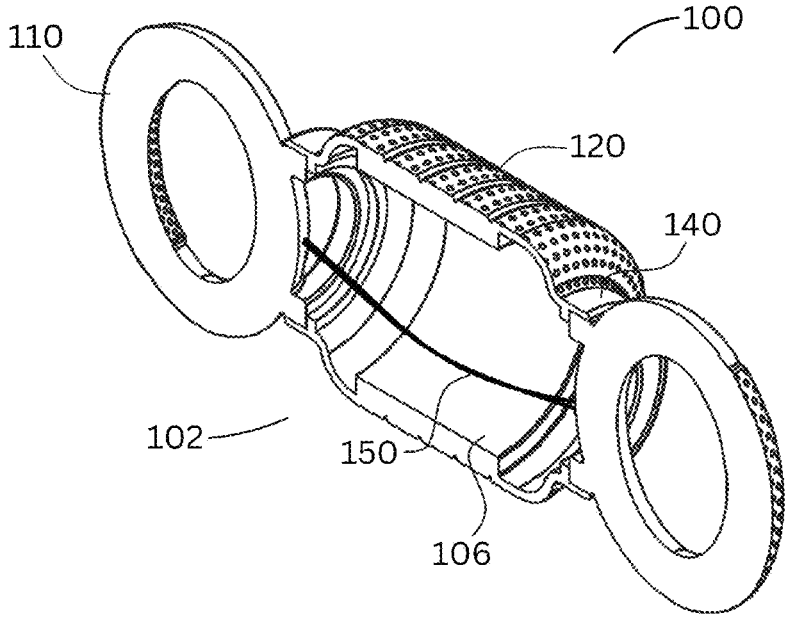
FIG. 7 is a horizontal perspective cross-sectional view of an alternative embodiment of the crumple toy in a contracted configuration.
Figure 8:
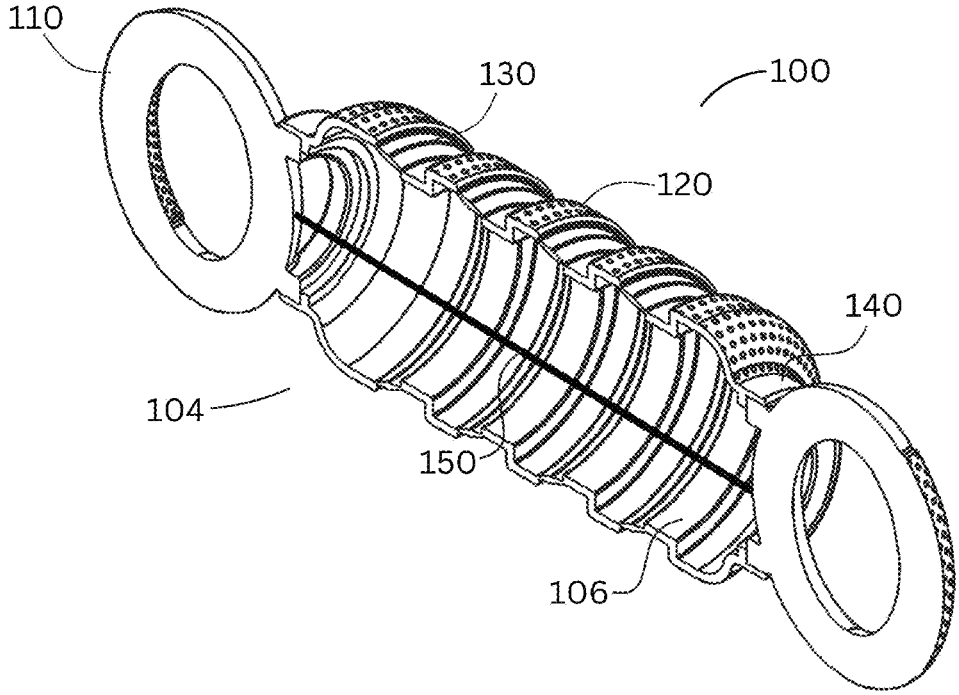
FIG. 8 is a horizontal perspective cross-sectional view of an alternative embodiment of the crumple toy in an extended configuration.
Figure 9:
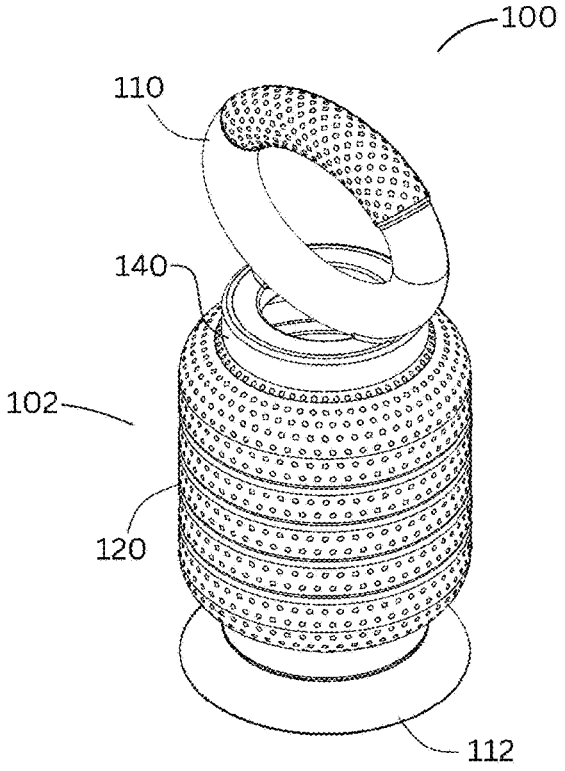
FIG. 9 is a perspective view of an alternative embodiment of the crumple toy in a contracted configuration.
Figure 10:
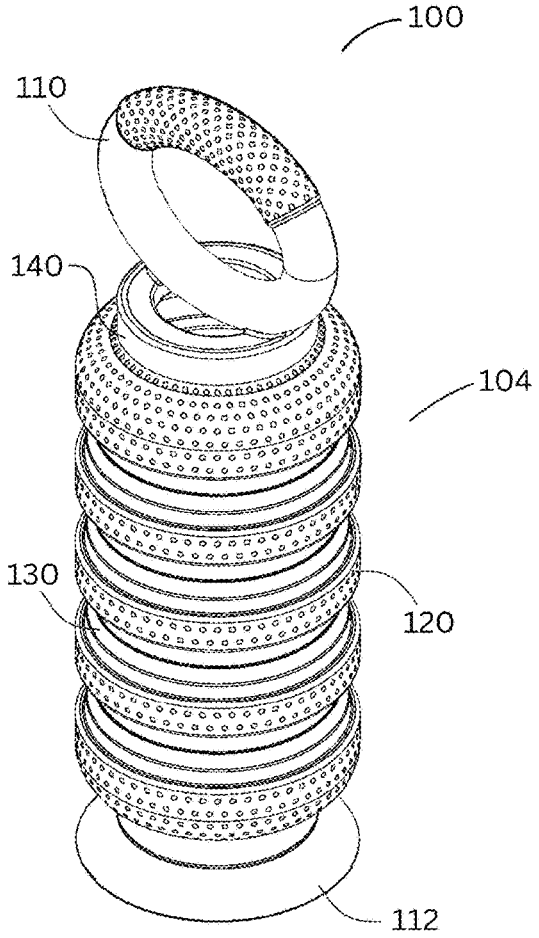
FIG. 10 is a perspective view of an alternative embodiment of the crumple toy in an extended configuration.
Figure 11:
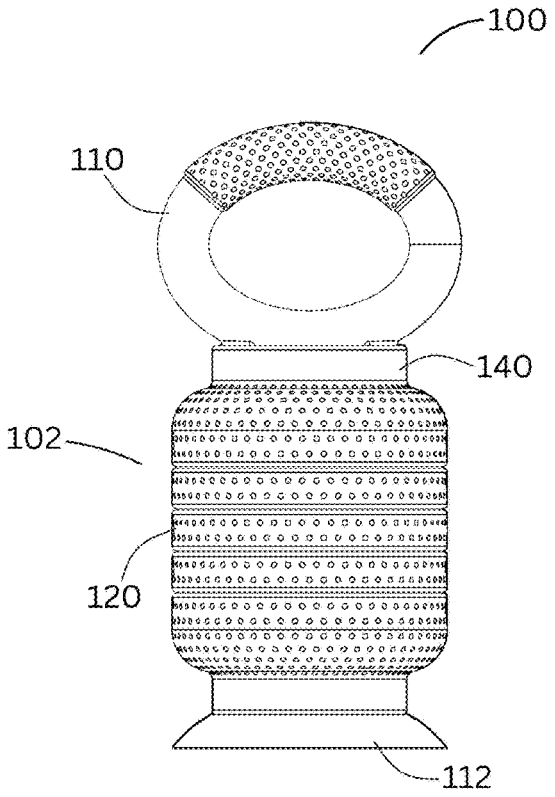
FIG. 11 is a front view of an alternative embodiment of the crumple toy in a contracted configuration.
Figure 12:
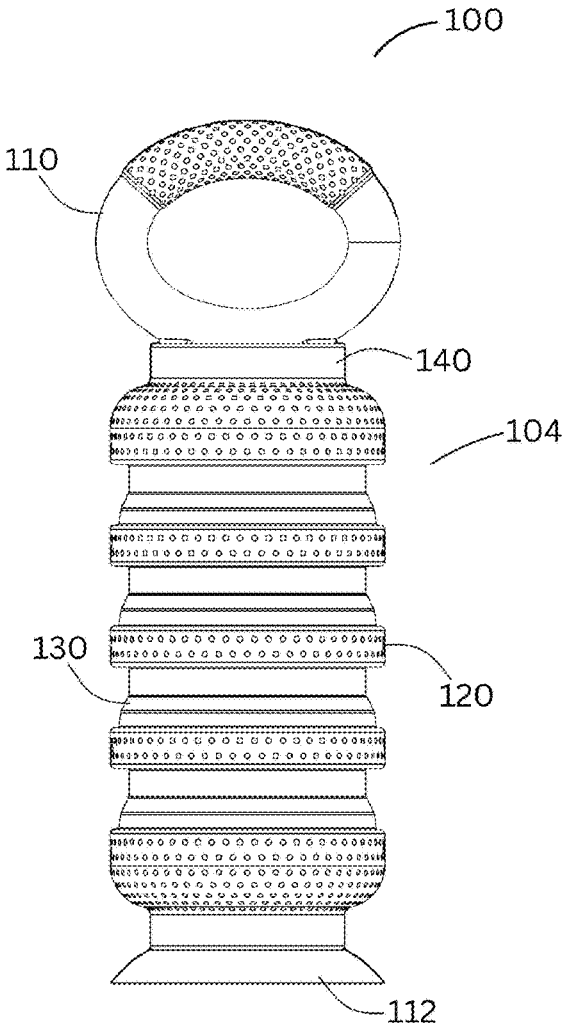
FIG. 12 is a front view of an alternative embodiment of the crumple toy in an extended configuration.
Figure 13:
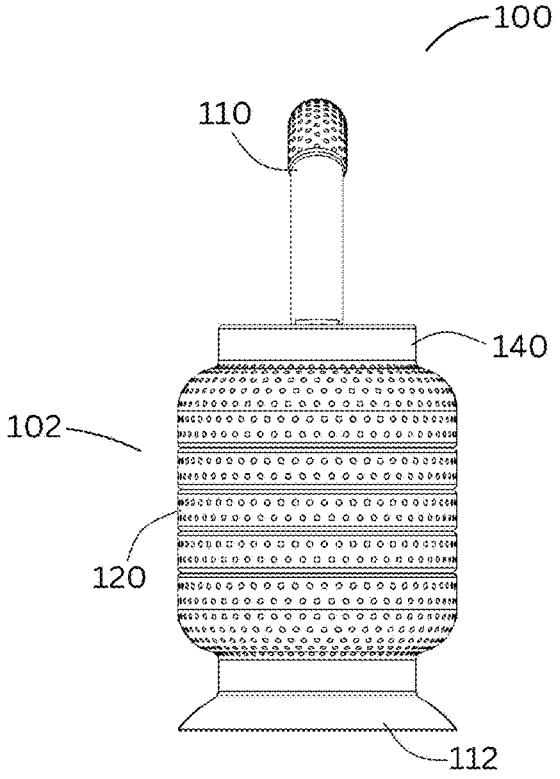
FIG. 13 is a right side view of an alternative embodiment of the crumple toy in a contracted configuration.
Figure 14:
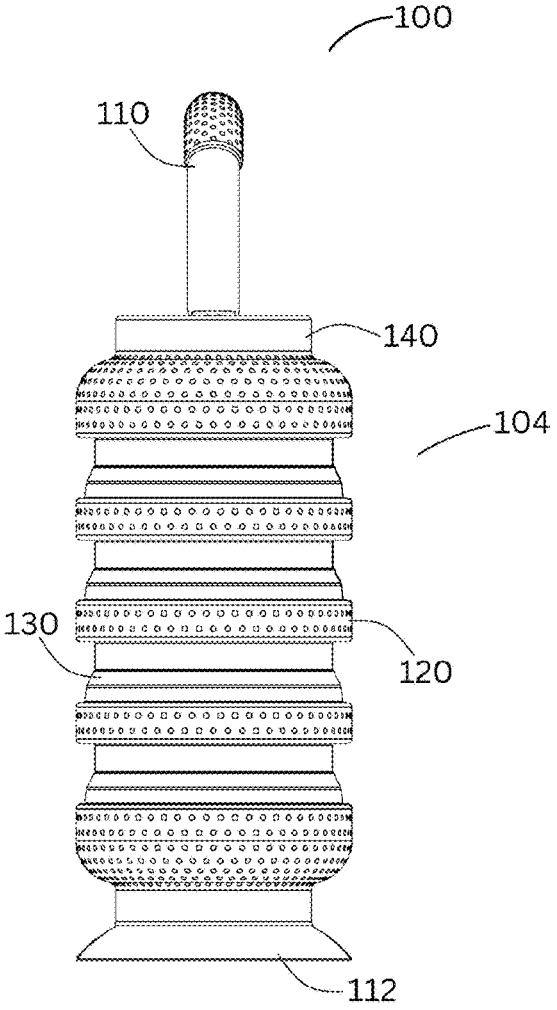
FIG. 14 is a right side view of an alternative embodiment of the crumple toy in an extended configuration.
Figure 15:
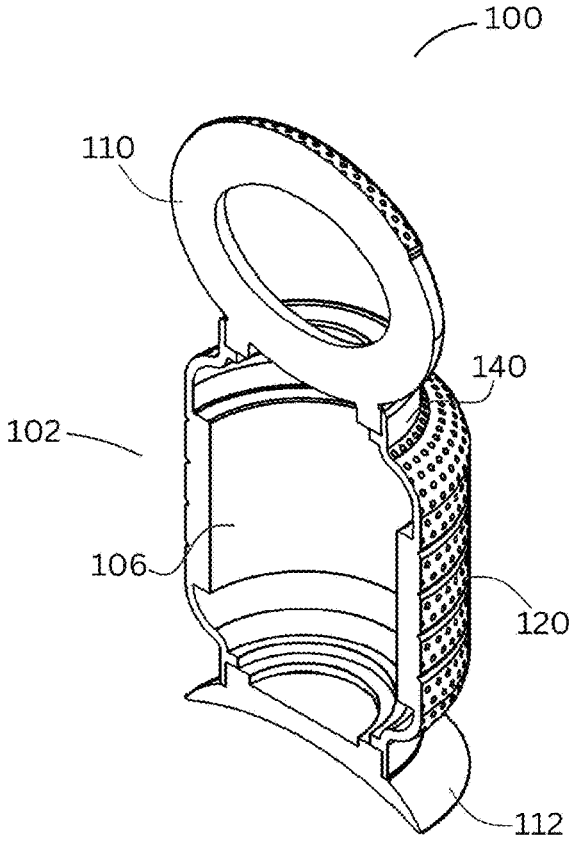
FIG. 15 is a perspective cross-sectional view of an alternative embodiment of the crumple toy in a contracted configuration.
Figure 16:
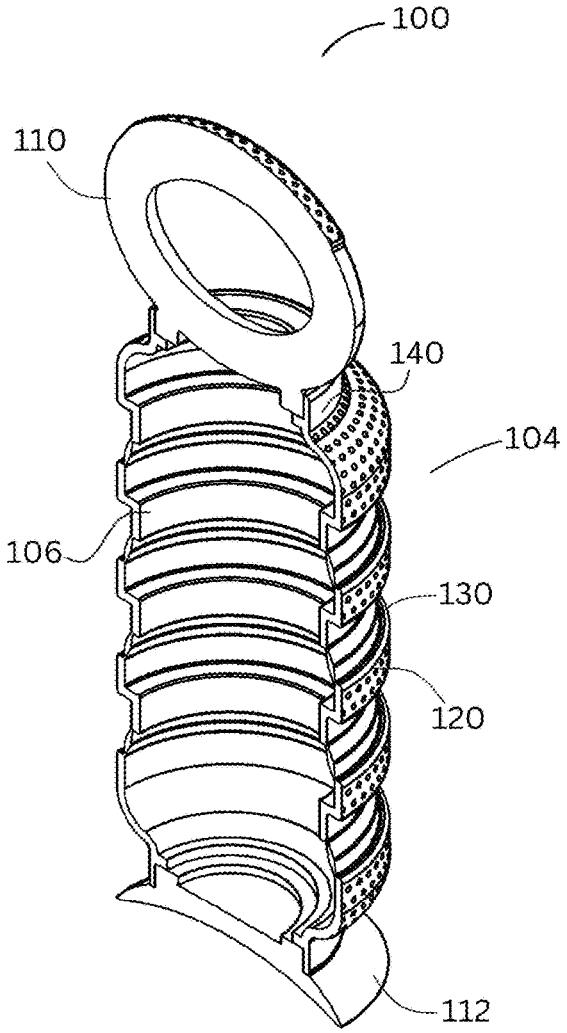
FIG. 16 is a perspective cross-sectional view of an alternative embodiment of the crumple toy in an extended configuration.
Figure 17:
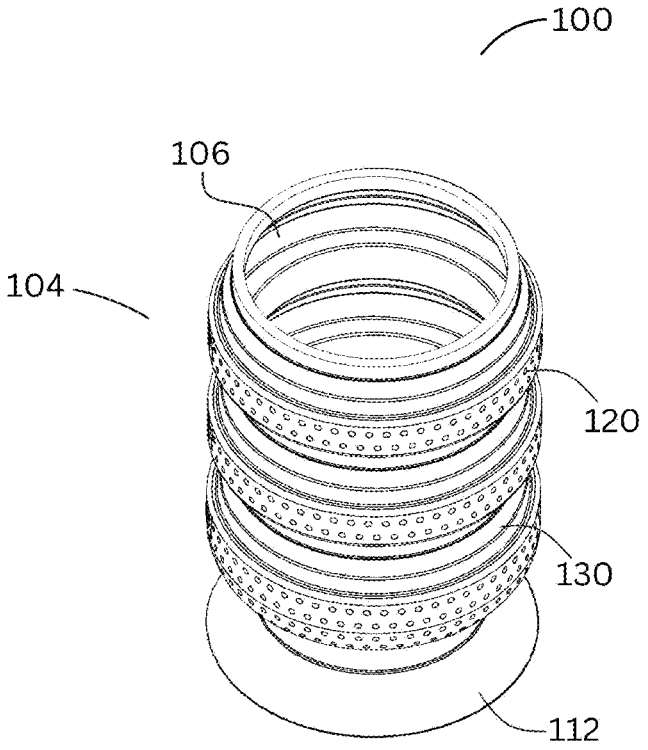
FIG. 17 is a perspective horizontal cross-sectional view of an alternative embodiment of the crumple toy in an extended configuration.

Referring to FIGS. 7 and 8 the inner cavity 106 may be hollow, solid, or partially hollow or solid. In the preferred embodiment the inner cavity 106 of the crumple toy 100 is hollow. In other embodiments the crumple toy 100 may be made of a solid material with a core extending throughout the body. The crumple toy 100 may have one or more openings or apertures in the body allowing access to the inner cavity 106. There may be an opening on either end or both ends of the crumple toy 100 or there may be no opening on either end. There may be more than one inner cavity 106 within the crumple toy 100. The cavities may be separated from each other or they may be connected by an opening. In an alternative embodiment the crumple toy 100 may have a rubber band 150 extended within the inner cavity 106 from one end to the other end and may be connected to the handles 110 or the collars 140 or any other part of the crumple toy 100. When in the contracted body 102 position the rubber band 150 may be loose and when pressure is applied outward along the longitudinal axis of the body of the crumple toy 100 the rubber band 150 may be elongated in the extended body 104 position and a reduction in outward pressure may return the crumple toy 100 to the contracted body 102 position. The rubber band 150 may also be elongated in the contracted body 102 position contracting the toy inward. There may be one or more than one rubber band 150 and may be attached internally or externally along the crumple toy 100. Any type of elastomeric material may be utilized either internally or externally to pull the crumple toy 100 in the contracted body 102 position. In other embodiments there may be any type of mechanical means to pull the toy into the contracted body 102 position, such as a screw, gear, spring, or any other component capable of creating and withstanding tension.

In another embodiment the crumple toy 100 has a rubber band 150 internal to the toy where the rubber band 150 is connected to an external handle or propeller. In this embodiment as the handle 110 or propeller is rotated, the rubber band 150 twists and pulls the toy into the contracted body 102 position. When the handle 110 or propeller is released, the tension on the rubber band 150 releases and the toy returns to the extended body 104 position. The handle 110 or propeller may spin due to the tension of the rubber band 150. In other embodiments the handle 110 or propeller does not spin due to the release of tension on the rubber band 150.

In alternative embodiments the crumple toy 100 may have an internal mechanism for automatically tensioning the rubber band 150. In this embodiment, pushing the toy from the extended body 104 position to the contracted body 102 position engages the internal mechanism. When the crumple toy 100 is released, the internal mechanism is engaged to spin a propeller. In other embodiments, when the crumple toy 100 is pulled from the contracted body 102 position to the extended body 104 position the internal mechanism is engaged and the propeller rotates when the crumple toy 100 returns to the extended body 104 position.

In alternative embodiments the crumple toy 100 is configured to be in either the contracted body 102 or extended body 104 position and then automatically return to either default position. There may be a spring or through the natural resilience of the material used may create the tension necessary for the crumple toy 100 to contract or extend automatically to the default position. In one embodiment there may be a spring that is molded into the body of the crumple toy 100. The spring may be placed in the ribs 120, in the folds 130, external to the body of the toy, or in an inner cavity 106 of the crumple toy 100. The spring may be any size and shape and may extend along the entire longitudinal axis of the crumple toy 100 or through only a portion of the crumple toy 100. The spring may be relaxed and designed to pull the crumple toy 100 into the contracted body 102 position. In this embodiment the spring is in the relaxed no load state when it is at its shortest longitudinal length. As the spring is extended the spring goes into a load state that pulls the crumple toy 100 back into the contracted body 102 position. The user would then extend the toy into the extended body 104 position and the spring would return the toy to the contracted body 102 position. In another embodiment the spring would start in a decompressed position and would be designed to return the crumple toy 100 to an extended body 104 position. As the spring is shortened it may be placed into a load state and the user would then push the crumple toy 100 into a contracted body 102 position and the spring would return the crumple toy 100 to the extended body 104 position. In an alternative embodiment the crumple toy 100 may be in a contracted body 102 position and the user engages a switch to allow the spring to decompress and extend to the extended body 104 position.

Referring to FIGS. 9-17 the crumple toy 100 may have one or more than one suction cup 112 on either or both ends of the crumple toy 100. The suction cup 112 may allow the crumple toy 100 to adhere to a wall, floor, window, table, or any other flat surface. The suction cup 112 may be located on any area of the crumple toy 100 and may be any shape and any size. The crumple toy 100 may have a suction cup 112 on one end and a handle 110 on the other end that when the suction cup 112 is adhered to a surface can be pulled in a direction away from the suction cup 112 causing the toy to expand to the extended body 104 position and when engaged in the opposite direction or pulled the crumple toy 100 is compacted in the contracted body 102 position. The body of the crumple toy 100 may have an inner cavity 106 that is fully open and the suction cup 112 may have a closed or open end. In another embodiment the crumple toy 100 has an open end with a handle 110 and a closed end with the suction cup 112. In other embodiments the crumple toy 100 may have both ends closed with suction cups 112 on either or both ends. In other embodiments, each end of the crumple toy 100 is open with full access to the internal cavity of the crumple toy 100 from the ends. In other embodiments, each end of the crumple toy 100 is closed so that there is no access to the internal cavity of the crumple toy 100 through the ends. In some embodiments one end of the crumple toy 100 is open and the other end of the crumple toy 100 is closed. There may be no other component disposed on the end of the crumple toy 100.

Figure 18:
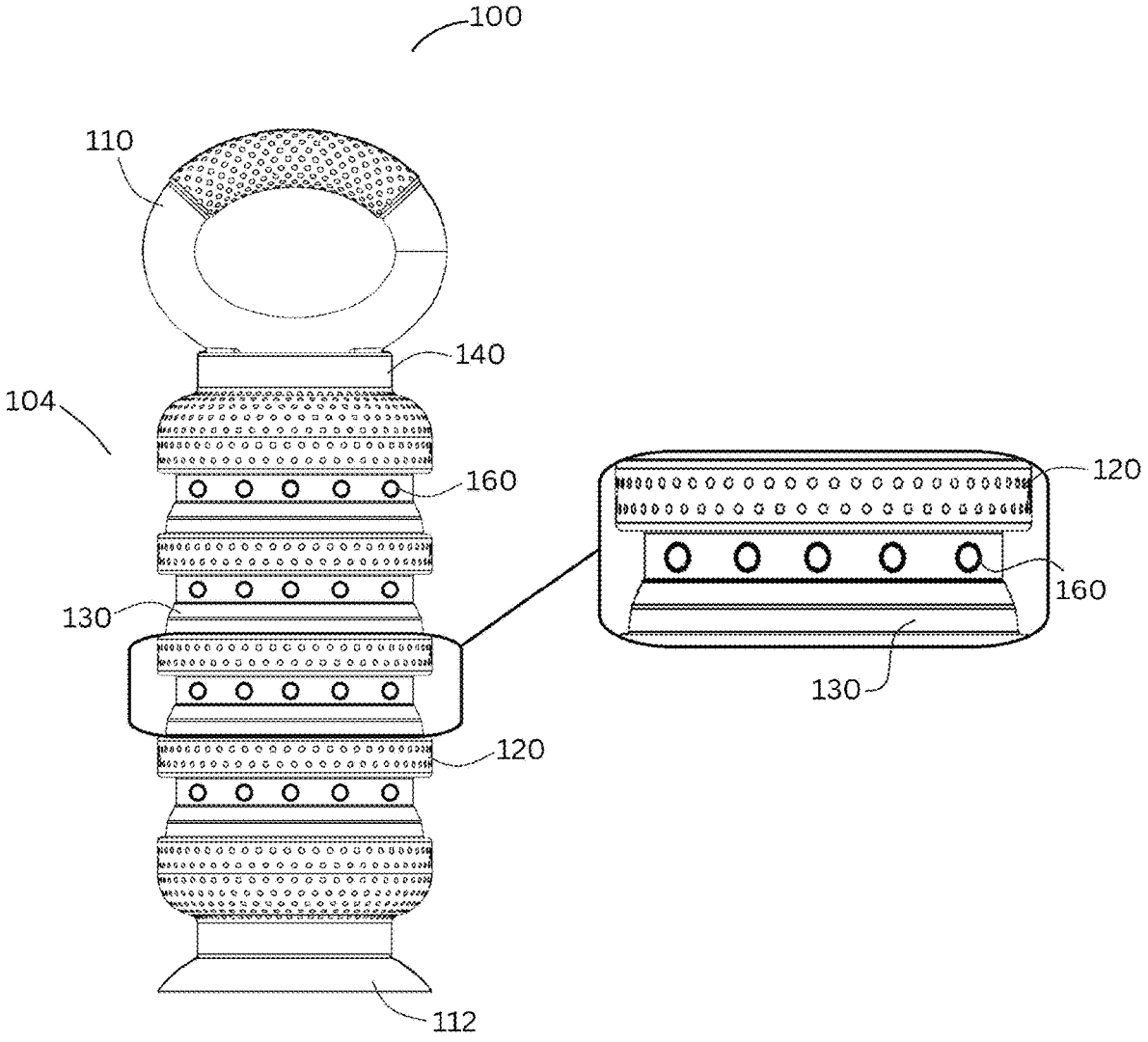
FIG. 18 is a front view of another alternative embodiment of the crumple toy in an extended configuration.

Now referring to FIG. 18 the crumple toy 100 may be designed as a bubble maker. In another embodiment there may be one or more than one or any number of apertures 160 in one or more than one of the folds 130. Soap or any other substance able to create bubbles may be added into the inner cavity 160 from the opening of the crumple toy 100. Soap suds may be formed when the user plunges the crumple toy 100 from the contracted body 102 position to the extended body 104 and repeated. In this embodiment the crumple toy 100 may have a suction cup 112 on one end and a handle 110 on the other end and the opening may be at the handle 110 portion. Through a repeated contraction and extension of the crumple toy 100 bubbles from the soap may form and expel from one or more than one aperture 160 of the folds 130.

Figure 19:
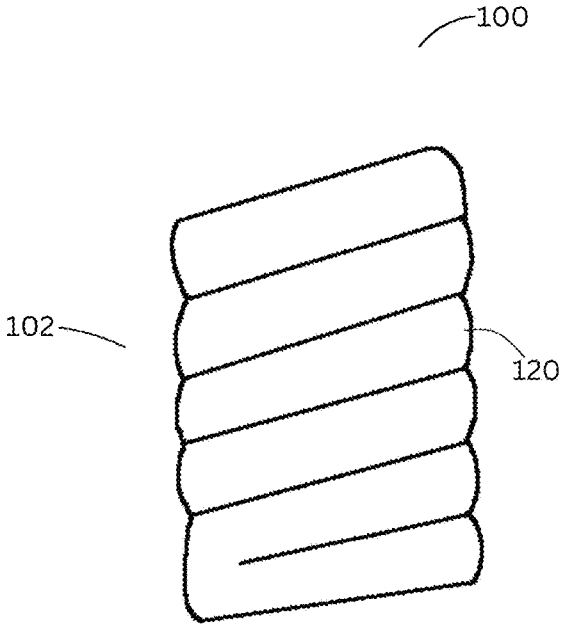
FIG. 19 is a front view of another alternative embodiment of the crumple toy in a contracted configuration.
Figure 20:
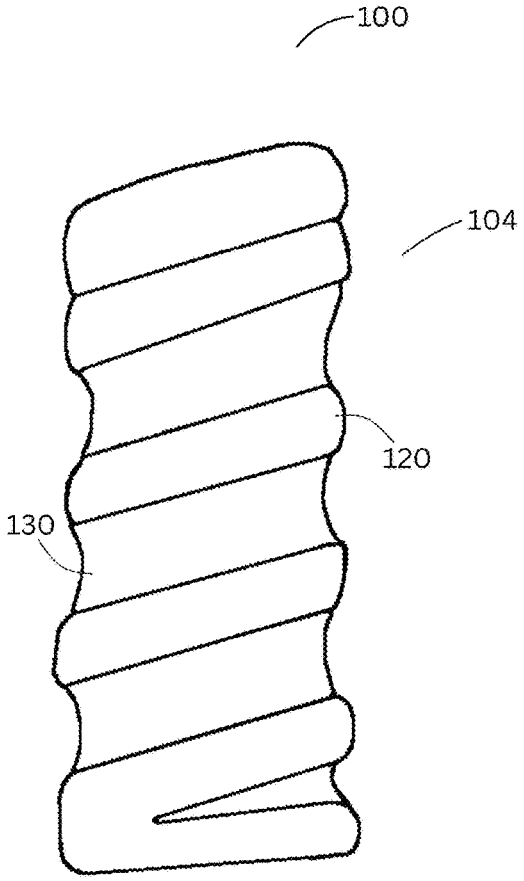
FIG. 20 is a front view of another alternative embodiment of the crumple toy in an extended configuration.

Referring to FIGS. 19 and 20 the crumple toy 100 may be designed in any shape or form and may have ribs 120 and folds 130 that twist and spiral around the longitudinal axis of the body when altered from the contracted body 102 position to the extended body 104 position. In this embodiment there may be any number of ribs 120 and folds 130 in any size or shape. In the extended body 104 position the ribs 120 and folds 130 may be orientated at any angle and may or not be perpendicular to the longitudinal axis of the body of the crumple toy 100. There may be zero or one or more than one handles 110 on either end or both ends or there may be zero or one or more than one suction cups 112 on either end or both ends of the crumple toy 100. The ribs 120 may be at any non-perpendicular angle to the longitudinal axis of the body and one or more than one ribs 120 may be connected with other ribs 120 on the crumple toy 100. The ribs 120 may spiral and rotate around the body of the crumple toy 100 from one end to an opposite end.

Figure 21:
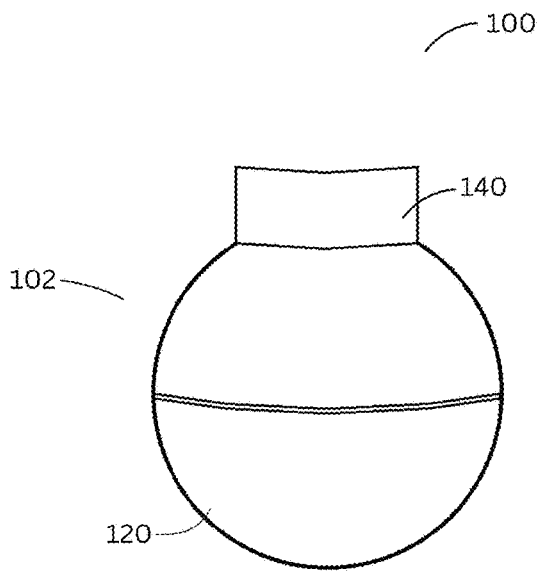
FIG. 21 is a front view of another alternative embodiment of the crumple toy in a contracted configuration.
Figure 22:
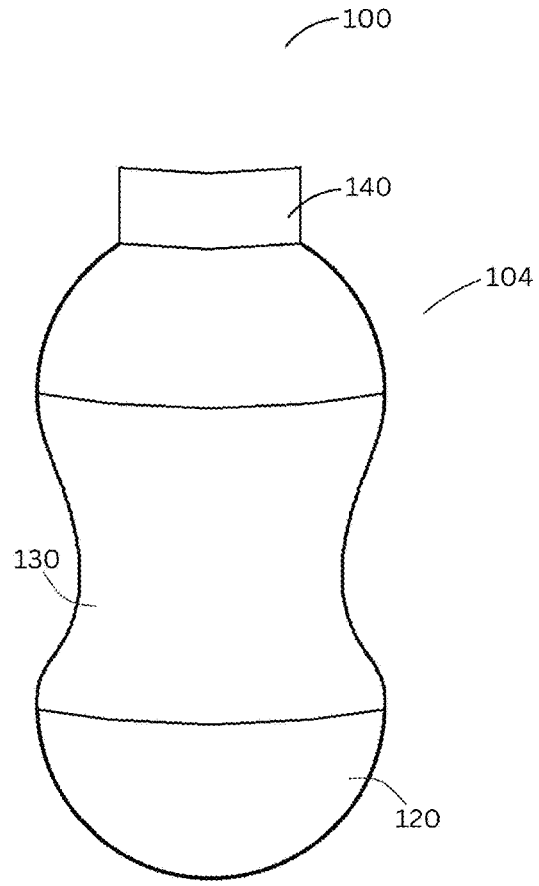
FIG. 22 is a front view of another alternative embodiment of the crumple toy in an extended configuration.

Referring to FIGS. 21 and 22 when the crumple toy 100 is in the contracted body 102 position the toy may be a sphere or generally spherical or any other geometric or non-geometric shape. In this embodiment there may be any number of ribs 120 and folds 130 in any size or shape. There may be zero or one or more than one handles 110 on either end or both ends or there may be zero or one or more than one suction cups 112 on either end or both ends of the crumple toy 100. There may be an opening at the collar 140 of this embodiment that may allow for water or any other liquid to be poured inside and as the crumple toy 100 is altered from the extended body 104 position to the contracted body position 102 the water or liquid may be forced to evacuate at the top of the collar 140 of the toy in resemblance of a fountain.

In other embodiments the crumple toy 100 is configured to make a noise when switched between the extended body 104 and contracted body 102 position, and vice versa. The crumple toy 100 may make a snapping or popping noise or any other noise when extended and contracted. The crumple toy 100 may contain a whistle in the body of the toy or in an internal compartment so that it makes a whistle sound. In other embodiments the crumple toy 100 may have resonating flaps that reproduce the sound of flatulence by use of an internal air bladder in the crumple toy 100. The extension of the crumple toy 100 may fill up the air bladder and the compression of the crumple toy 100 may void the air bladder. The internal air bladder may simply be an air tight chamber or a separate and distinct component of the crumple toy 100. The crumple toy 100 may also include an electrical fan to automatically inflate or deflate the air bladder or air chamber.

In still other embodiments the crumple toy 100 further comprises an expanding foam or other self-expanding material within the body of the crumple toy 100. This configuration makes the toy self-rising to the extended body 104 position. In other embodiments the crumple toy 100 further comprises an electromotor within the inner cavity 106 of the crumple toy 100. The electromotor may have a band attached to one end of the crumple toy 100 that is pulled or pushed by the electromotor to change the configuration of the crumple toy 100 from the contracted body 102 position to the extended body 104 position or vice versa.

In other embodiments the crumple toy 100 has an internal valve positioned between two sections of the crumple toy 100. In this embodiment one section of the crumple toy 100 is in the extended body 104 position and the other section is in the contracted body 102 position. The valve permits air or fluid to pass through one section to the other. In this manner, when the one section is compressed into the contracted body 102 position the air of fluid passes through the valve to change the other section from the contracted body 102 position to the extended body 104 position. The crumple toy 100 may have a handle on the outside of the toy. In this configuration the crumple toy 100 is similar to a hammer and when one section of the crumple toy 100 is hit the section is compressed and the second section changes to the extended body 104 position.

In other embodiments the crumple toy 100 may be affixed to a base. The base may be any size and shape and may be made of any material. In this embodiment the base is attached to one end of the toy so that the longitudinal axis of the crumple toy 100 is perpendicular to the plane of the base. There may be multiple crumple toys 100 disposed in the base. In some embodiments the base has one or more air channels extending between the different crumple toys 100. In this manner the compression of one crumple toy 100 causes air to flow to another crumple toy 100 and causes the second one to extend. In other embodiments the base may include a manual air pump that either inflates or deflates a crumple toy 100 in the base. In still other embodiments there is an air release channel in the base that allows the air to escape to atmosphere.

In another embodiment there are a plurality of crumple toys 100 connected axially to a central point. The central point may allow the plurality of crumple toys 100 to spin around its axis. The central point may have an internal valve that allows air from one crumple toy 100 to move to another crumple toy 100. Optionally the crumple toys 100 are not connected together with an air valve. In another embodiment the crumple toy 100 is configured with air valves, apertures, bells, rattles, or any other noise making device. In one embodiment the crumple toy 100 is similar to an accordion. When the crumple toy 100 is compressed air within the toy may be expelled through one or more apertures. The crumple toy 100 may make music when it compressed or when it is extended. The crumple toy 100 may have finger valves or keys to make the crumple toy 100 change the musical pitch of the sound expelled.

The crumple toy 100 may be utilized to create a suction force in other embodiments. In this embodiment the crumple toy 100 starts in the contracted body 102 position. As the user pulls the crumple toy 100 into the extended body 104 position the toy creates an internal vacuum. The internal vacuum can be utilized in any type of interactive toy. In one embodiment there are two crumple toys 100 connected together with one in the extended body 104 position and one contracted body 102 position with a channel between the two for air to travel. The user pulls the contracted body 102 crumple toy 100 into the extended body 104 position which creates a vacuum and pulls the air from the extended body 104 crumple toy. This vacuum causes the extended body 104 crumple toy 100 to then move into the contracted body 102 position.

In other embodiments the crumple toy 100 is configured as a baby toy. In this embodiment the crumple toy 100 may have a handle 110. The toy may contain a rattle noise maker, crumple sound maker, whistle, or any other noise maker. The crumple toy 110 may be configured to permit a baby to chew on the toy for teething purposes. The crumple toy 100 may be designed to be placed on a pacifier.

In some embodiments the crumple toy 100 may be utilized as a blower. A user may blow into one end of the crumple toy 100 to cause the toy to extend. In this embodiment the crumple toy 100 may further comprise a whistle, party blower squeaker, or flatulence noise maker at the end. The crumple toy 100 may be straight or curved when blown into the extended body 104 position.

In some embodiments the crumple toy 100 is utilized as an internal skeleton or support for a plush toy or any other toy. In this embodiment the crumple toy 100 may be covered by cotton or any other material. The plush toy can be any size and shape. In other embodiments the toy is covered by a fabric skin without cotton. In other embodiments the crumple toy 100 is a skeleton for a figurine constructed out of silicone. In other embodiments the crumple toy 100 is a skeleton with a polymeric resilient cover such as a balloon or a ball. The ball may be filled with fluid or air. The crumple toy 100 may be made of any material and may serve as a skeleton for a toy made out of any material. The crumple toy 100 may be extended in an extended body 104 position and contracted in a contracted body 102 position while contained in the outer covering.

In other embodiments the crumple toy 100 is connected with a pump. In this embodiment the pump pushes air through a channel to cause the crumple toy 100 to move from the contracted body 102 position to the extended body 104 position. In another embodiment the pump creates a vacuum inside the crumple toy 100 to cause the toy to move from an extended body 104 position to the contracted body 102 position.

The crumple toy 100 may be configured with specific air release configurations. In this embodiment the toy may have one or more perforations in the folds 130 or the ribs 120. The air can be released through all of the perforations at the same time or through certain perforations at different times. A user may use their fingers to cover certain perforations while in use.

In another configuration one end of the crumple toy 100 is attached to a silicone air ball. A user can squeeze the air ball to cause air to pass into the crumple toy 100 and move from the contracted body 102 position to the extended body 104 position. When the user moves the toy back to the contracted body 102 position the air leaves the crumple toy 100 and moves back to the silicone air ball. In other embodiments the ball may be replaced by any type of elastomer material that behaves as a deformable bladder. There may be one or more crumple toys 100 connected to the same silicone air ball. There may be one or more air valves connected to the silicone air ball. In this embodiment squeezing the ball may cause one or more crumple toys 100 to extend to the extended body 102 position. Moving one of the crumple toys 100 into the contracted body 102 position may refill the silicone air ball or may cause another crumple toy 100 to move into an extended body 104 position.

In another embodiment the crumple toy may be used as a water fountain. In this embodiment there may be a suction cup 112 at the bottom of the crumple toy 100. This is used to keep the toy connected to the bottom of a bathtub or any smooth surface. The bottom of the crumple toy 100 may have a one-way valve to intake water within the bathtub. The crumple toy 100 may have one or more handles 110 in this configuration. At the top end of the crumple toy 100 there are one or more holes for water to squirt from. Pulling the crumple toy 100 from a contracted body 102 position to an extended body 104 position pulls water into the crumple toy 100 through the valve to fill a reservoir. Pushing the toy back into the contracted body 102 position causes water to squirt out of the holes at the top. In this embodiment there may be a second reservoir for the crumple toy 100 to hold soap so that the crumple toy 100 can be may be able to create bubbles in a bathtub.

In another embodiment the crumple toy 100 is configured as a squirt gun. The crumple toy 100 may have a reservoir or water connected to the crumple toy 100. Pushing the toy into the contracted body 102 position from the extended body 104 position causes the crumple toy 100 to shoot water. In other configurations the crumple toy 100 may use air to shoot foam balls, arrows, or any type of toy projectile out of the toy. In other embodiments the crumple toy 100 may be connected to a tube that holds a toy rocket. As the crumple toy 100 is compressed, the air is forced into the tube to propel the rocket from the tube.

In other embodiments the crumple toy 100 may be utilized as a step or a pump. In this embodiment the default position of the crumple toy 100 is the extended body 104 position. The user then steps on the crumple toy 100 to cause the crumple toy 104 to move into the contracted body 102 position. When stepped on the crumple toy 100 expels air. The crumple toy 104 may have a self-inflating bladder inside the crumple toy 100. The crumple toy 100 may be stand alone or incorporated into another item. The crumple toy 100 may be used as a whoopie cushion so that when stepped on it creates the sound of flatulence.

In another embodiment the crumple toy 100 is used to launch toy cars. A toy car may be placed inside the crumple toy 100 when it is placed in the extended body 104 position. The user then pushes the toy into the contracted body 102 position to launch the toy car out of the crumple toy 100. The crumple toy 100 may further comprise a mechanism to wind up a tension motor within the car. The tension motor releases the tension to the wheels of the car and causes the wheels to spin. The crumple toy 100 may further comprise a vehicle on a track within the body of the crumple toy 100. As the crumple toy 100 moves into the extended body 104 position the vehicle may move along the track from one end to the other. The track may be pliable so that it folds up within the crumple toy 100 or the track may be firm and extend beyond the body of the crumple toy 100.

In other embodiments the crumple toy 100 may be worn on the feet of a user. In this embodiment the crumple toy 100 may spring open to the extended body 104 position when the user lifts his foot. The weight of the user then compresses the toy into the contracted body 102 position when the user steps on the toy. In other embodiments the crumple toys 100 have suction cups 112 placed on the bottom of the crumple toys 100 so that the crumple toy 100 is positioned between the foot of the user and the suction cup 112. The suction cups 112 in this embodiment would engage the floor and create a popping sound when the user lifts his foot off the ground.

In another embodiment the crumple toy 100 may be included in a flashlight, sword, or "light saber." In this embodiment there may be an internal light that illuminates the crumple toy 100. There may be a handle 110 connected to the crumple toy 100. The handle 110 may have a switch that causes the crumple toy 100 to extend when switched.

In still another embodiment the crumple toy 100 may have a suction cup 112 within the inner cavity 106 that when the crumple toy 100 is in the contracted body 102 position the suction cup 112 is releasably coupled to any smooth surface for any period of time. In this embodiment there may be a spring within the inner cavity 106 that extends to a relaxed state when the suction cup 112 releases from the attached surface and forces the crumple toy 100 into an extended body 104 position. The base of the crumple toy 100 may be open allowing for the suction cup 112 to releasably couple to said surface.

In another embodiment there may be one or more than one crumple toys 100 coupled on an inner portion of a toy ring. The crumple toys may releasably couple to one another by suction cups 112. The outer portion of the ring may have handles 110 for a user to separate and join the crumple toys 100.

In another embodiment the crumple toy 100 may further comprise a connector permitting it to be connected to another crumple toy 100. The connecter may be any type of connector. In the preferred embodiment the connector is a ball and socket such that the ball on one crumple toy 100 connects to the socket of another crumple toy 100. In some embodiments the crumple toy 100 may be of sufficient length and malleability to permit the ball of the crumple toy 100 to be connected to a socket on the same crumple toy 100. In other embodiments the connectors may be suction cups, male and female releasable components, zippers, buttons, snaps, or any other type of component that can be utilized to removably connect two crumple toys 100 together. There may be multiple connectors on a single crumple toy 100 such that the multiple crumple toys 100 can be connected together. In this manner multiple crumple toys 100 can be connected together as a building or construction set.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A toy comprising a) a longitudinal body having a first end and a second end opposite said first end, said longitudinal body comprising a plurality of ribs and a plurality of folds;

b) wherein at least one of said plurality of ribs is disposed between two of said plurality of folds;

c) wherein at least one of said plurality of folds is disposed between two of said plurality of ribs;

d) wherein said longitudinal body is configured to be adjusted between a first configuration and a second configuration;

i) wherein when said longitudinal body is in said first configuration two adjacent ribs are in a distal position relative to each other with an intervening fold in an unfolded position;

ii) wherein when said longitudinal body is in said second configuration two adjacent ribs are disposed proximal relative to each other with an intervening fold in a folded position;

e) a first handle disposed at said first end;

f) wherein said first end further comprises a closed first end and said second end further comprises a closed second end, such that said closed first end, said closed second end, and said longitudinal body define an internal cavity having no interaction with space outside of said longitudinal body; and g) wherein when said longitudinal body is in said first configuration said internal cavity creates a vacuum relative to space outside of said longitudinal body.

2. The toy as in claim 1 wherein said vacuum causes said longitudinal body to compress into said second configuration.

3. The toy as in claim 1 further comprising a second handle disposed at said second end.

4. The toy as in claim 1 further comprising a suction cup disposed at said second end.

5. The toy as in claim 1 further comprising a plurality of lateral protrusions extending substantially perpendicular to said longitudinal axis.

6. A toy comprising a) a longitudinal body having a first end and a second end opposite said first end, said longitudinal body comprising a plurality of ribs and a plurality of folds;

b) wherein at least one of said plurality of ribs is disposed between two of said plurality of folds;

c) wherein at least one of said plurality of folds is disposed between two of said plurality of ribs;

d) wherein said longitudinal body is configured to be adjusted between a first configuration and a second configuration;

i) wherein when said longitudinal body is in said first configuration two adjacent ribs are in a distal position relative to each other with an intervening fold in an unfolded position;

ii) wherein when said longitudinal body is in said second configuration two adjacent ribs are disposed proximal relative to each other with an intervening fold in a folded position;

e) a first handle disposed at said first end;

f) wherein said first end further comprises a closed first end and said second end further comprises a closed second end, such that said closed first end, said closed second end, and said longitudinal body define an internal cavity having no interaction with space outside of said longitudinal body; and g) wherein when said longitudinal body is in said second configuration said internal cavity creates positive air pressure relative to space outside of said longitudinal body.

7. The toy as in claim 6 wherein said positive air pressure causes said longitudinal body to extend to said first configuration.

8. The toy as in claim 6 further comprising a second handle disposed at said second end.

9. The toy as in claim 6 further comprising a suction cup disposed at said second end.

10. The toy as in claim 6 further comprising a plurality of lateral protrusions extending substantially perpendicular to said longitudinal axis.

11. A toy comprising a) a longitudinal body having a first end and a second end opposite said first end, said longitudinal body comprising a plurality of ribs and a plurality of folds;

b) wherein at least one of said plurality of ribs is disposed between two of said plurality of folds;

c) wherein at least one of said plurality of folds is disposed between two of said plurality of ribs;

d) wherein said longitudinal body is configured to be adjusted between a first configuration and a second configuration;

i) wherein when said longitudinal body is in said first configuration two adjacent ribs are in a distal position relative to each other with an intervening fold in an unfolded position;

ii) wherein when said longitudinal body is in said second configuration two adjacent ribs are disposed proximal relative to each other with an intervening fold in a folded position;

e) a first handle disposed at said first end; and f) one or more compressible dimples disposed in at least one of said plurality of ribs.

12. The toy as in claim 11 further comprising a second handle disposed at said second end.

13. The toy as in claim 11 further comprising a suction cup disposed at said second end.

14. A toy comprising a) a longitudinal body having a first end and a second end opposite said first end, said longitudinal body comprising a plurality of ribs and a plurality of folds;

b) wherein at least one of said plurality of ribs is disposed between two of said plurality of folds;

c) wherein at least one of said plurality of folds is disposed between two of said plurality of ribs;

d) wherein said longitudinal body is configured to be adjusted between a first configuration and a second configuration;

i) wherein when said longitudinal body is in said first configuration said longitudinal body is fully extended along a longitudinal axis such that said first end is disposed at a maximum distance from said second end;

ii) wherein when said longitudinal body is in said second configuration said longitudinal body is compressed along a longitudinal axis such that said first end is disposed at less than said maximum distance from said second end;

e) a first handle disposed at said first end;

f) wherein said first end further comprises a closed first end and said second end further comprises a closed second end, such that said closed first end, said closed second end, and said longitudinal body define an internal cavity having no interaction with space outside of said longitudinal body;

g) wherein when said longitudinal body is in said first configuration said internal cavity creates a vacuum relative to space outside of said longitudinal body; and h) wherein said vacuum causes said longitudinal body to compress into said second configuration.

15. The toy as in claim 14 further comprising a second handle disposed at said second end.

16. The toy as in claim 14 further comprising a suction cup disposed at said second end.

17. The toy as in claim 14 further comprising a plurality of lateral protrusions extending substantially perpendicular to said longitudinal axis.

18. A toy comprising a) a longitudinal body having a first end and a second end opposite said first end, said longitudinal body comprising a plurality of ribs and a plurality of folds;

b) wherein at least one of said plurality of ribs is disposed between two of said plurality of folds;

c) wherein at least one of said plurality of folds is disposed between two of said plurality of ribs;

d) wherein said longitudinal body is configured to be adjusted between a first configuration and a second configuration;

i) wherein when said longitudinal body is in said first configuration said longitudinal body is fully extended along a longitudinal axis such that said first end is disposed at a maximum distance from said second end;

ii) wherein when said longitudinal body is in said second configuration said longitudinal body is compressed along a longitudinal axis such that said first end is disposed at less than said maximum distance from said second end;

e) a first handle disposed at said first end;

f) wherein said first end further comprises a closed first end and said second end further comprises a closed second end, such that said closed first end, said closed second end, and said longitudinal body define an internal cavity having no interaction with space outside of said longitudinal body;

g) wherein when said longitudinal body is in said second configuration said internal cavity creates positive air pressure relative to space outside of said longitudinal body; and h) wherein said positive air pressure causes said longitudinal body to extend to said first configuration.

19. The toy as in claim 18 further comprising a second handle disposed at said second end.

20. The toy as in claim 18 further comprising a suction cup disposed at said second end.

21. The toy as in claim 18 further comprising a plurality of lateral protrusions extending substantially perpendicular to said longitudinal axis.

* * * * *